US005713482A

United States Patent [19]

Bordner et al.

[11] Patent Number: 5,713,482

[45] Date of Patent: Feb. 3, 1998

[54] POLYMERIC SPLIT RING CLAMP

[75] Inventors: Paul G. Bordner, Pickerington; Bret D. Bordner, Groveport, both of Ohio; Richard P. Brandt; Marshall K. Blum, both of Crystal Lake, Ill.

[73] Assignee: Container Accessories, Inc., Reynoldsburg, Ohio

[21] Appl. No.: 643,249

[22] Filed: May 2, 1996

[51] Int. Cl.[6] ..... B65D 45/34

[52] U.S. Cl. ..... 220/321; 220/320; 292/256.69

[58] Field of Search ..... 220/320, 321, 220/686; 215/275, 286; 292/256.65, 256.69, DIG. 49

[56] References Cited

U.S. PATENT DOCUMENTS

| | | | |
|---|---|---|---|
| 3,897,884 | 8/1975 | Lankenau | 220/320 |
| 4,135,657 | 1/1979 | Benson et al. | 220/321 X |
| 5,129,537 | 7/1992 | Bordner et al. | 220/321 |
| 5,299,707 | 4/1994 | Stolzman | 220/321 |

*Primary Examiner*—Stephen Cronin

*Attorney, Agent, or Firm*—Mueller and Smith, LPA

[57] ABSTRACT

A split ring clamp for retaining a lid upon an enclosure such as a plastic or fibrous drum is provided which is formed entirely of polymeric material such as a high molecular weight, high density polyethylene copolymer. The assemblage includes two parts, a channel-form split ring and a pivot arm joining the two ends of the split ring together over the rim structure of a container. One end of the ring supports an integrally formed pivot shaft receiving notch as well as an outwardly extending toe with a rearwardly disposed contact surface. The opposite side of the ring is formed having a receiver channel within which there is provided an inwardly depending toe with a rearwardly facing contact surface. The pivot arm is formed having a transversely disposed arm pivot shaft and a ring pivot shaft receiving notch having a shaft access opening which is outwardly disposed and extends to a shaft bearing surface. Such an arrangement permits a more thin profile for the ring and pivot arm assembly. The arm pivot shaft pivotally engages the ring receiving notch and the ring pivot shaft receiving notch receives the ring pivot shaft in a slideable engagement. When closed, the contact surfaces of the two toes of the ring engage in stress transfer relationship to relieve excess stress on the pivot arm itself.

32 Claims, 6 Drawing Sheets

POLYMERIC SPLIT RING CLAMP

BACKGROUND OF THE INVENTION

Cylindrical containers intended for retaining chemicals, industrial materials, and the like, when configured in larger, drum sizes generally are structured either of a metal such as steel or, particularly in North America, of a fiber material. Such fiber drums are formed having a metal chime and a replaceable lid which typically is retained in position by a split ring clamp. Other regions of the globe, particularly Europe and the Far East, form such non-metallic varieties of drums of a plastic rather than fibrous material. With the rapid globalization of commerce, a trend toward a somewhat universal use of plastic material for fabricating drums and associated lids has been observed. In this regard, there are ecological advantages associated with such uses of plastic, the material forming the drums and lids, for the most part, being recoverable. International standards also are developing which may supplant national standards for the performance of these drums. From a national standpoint, the United States Department of Transportation (DOT), Research and Special Programs Administration, promulgate specifications for drum performance See generally 49 CFR Ch. (Oct. 1, 1988 Ed.), Sec. 178.244-2. Standards also have been promulgated by the United Nations organization. DOT standards typically call for drop tests wherein the drums and lids as clamped in position are filled with dry, finely powdered material to an authorized net weight and closed. Depending upon the standards involved, the containers then are called upon to withstand a drop from varying heights and orientations on-to a hard surface such as concrete. To pass such tests or standards, the drums must recover from such drops without rupture or leakage. One international test approach involves a similar drop test except that the drums are filled with water instead of powdered materials. Such tests also include a seal test wherein the drums are filled with water and upended to determine the presence of leakage.

Lids typically enclosing the drums are formed as stamped metal or plastic components which are secured over the rim-chime assemblies with metal split ring clamps having a channel or U-shaped cross section, the lower inwardly named side or edge of which engages a rim or groove of the lid drum interface and the upper side of which abuts over the lid top. An over center lever generally is used or draw the ends of the split ring clamp structure together. For many packaging, transportation, and incinerator container applications, industrial users of such strucures have sought to avoid metal components such as lids and lid retained including the split ring clamping device. These metal devices do not burn, are prone to corrode, or, importantly, to insert minute metallic contaminants with the material packaged within the containers. Plastic lids have been successfully developed, for example as described in U.S. Pat. No. 4,718,571, by Bordner and for some period of time, the development of corresponding plastic clamping rings which remain competitive in terms of cost and securement performance was an elusive objective for investigators until Bordner, et al., evolved a successful all plastic polymeric two-piece split ring clamp. This clamp which found success in conjunction with fiber type drums, is described in U.S. Pat. No. 5,129,537, issued Jul. 14, 1992, and entitled "Two-Piece Polymeric Lid Clamping Ring".

While the two-piece polymeric split ring clamp by Bordner, et al., remains popular for use with fiber-based drums, its experimental application to use in clamping plastic lids on plastic drums has demonstrated a need for a more secure union between drum and lid. Further, the split ring clamp, while advantageously being formed of only two parts has been observed to exhibit a profile at its over-center pivot arm which protrudes outwardly from the side of the drum and lid to which it is secured a substantial amount, a condition which hinders drum handling. When subjected to drop tests employing plastic lids and a plastic drum, excessive stress was imposed, for example, upon the arm pivot shaft or pin integrally formed upon the pivot arm of the clamping system.

SUMMARY

The present invention is addressed to a split ring clamp for retaining a lid upon a rim of a cylindrical container. The split ring clamp of the invention retains the advantages of the Bordner, et al. clamp in that it is formed of only two parts, a split ring and a pivot arm. Further, the present split ring clamp structure exhibits the enhanced attributes of being formed of a plastic, non-contaminating and non-corroding polymeric material while remaining competitive in terms of cost with respect to metal clamp assemblies and being formed of a material which is recyclable and may be U.V. stabilized by the incorporation of a U.V. screen. No sharp edges are developed upon the molded plastic clamps, thus they are more safe during handling. However, the polymeric clamp of the invention is capable of withstanding greater stress while having a more thin or narrow profile in the vicinity of its pivot arm when closed or locked in position retaining a lid on a drum. For example, the outwardly extending profile of the split ring clamp at its pivot arm is about ⅜ inch thinner. A preferred feature of the clamp provides a uniquely structured keyway and locking key. This feature is quite simple to use and provides a dual form of security or integrity of the clamping system.

Another feature of the invention is to provide a split ring clamp for retaining a lid upon the rim of a cylindrical container at the interface therebetween. The clamp includes an inwardly opening channel-form ring formed of polymeric material, having a first end with oppositely disposed side surfaces, having an outwardly extending toe with a rearwardly disposed first contact surface and an outwardly extending rearwardly opening pivot shaft receiving notch. The ring has an oppositely disposed second end including a receiver channel having oppositely disposed spaced apart sides defining an opening. The spaced-apart sides have mutually inwardly facing internal surfaces which are slideably movable in adjacency over the side surfaces of the fast end. The receiver channel includes an inwardly depending toe with a rearwardly facing second contact surface configured in correspondence with the first contact surface. This second end receiver channel includes a ring pivot shaft extending between the spaced apart sides forwardly of the opening. A pivot arm is provided having a pivot end with a transversely disposed arm pivot shaft, a ring pivot shaft receiving notch having a shaft access opening extending to a shaft bearing surface spaced from the arm pivot shaft a distance selected for drawing together the ring first and second ends to an extent effective to cause an abutting, stress transfer engagement of the first contact surface with the second contact surface and extending therefrom to form a lever, the arm pivot shaft being configured for slideable engagement with the ring first end pivot shaft receiving notch and the ring shaft receiving notch being configured for slideably receiving the second end ring pivot shaft.

As another feature, the invention provides a split ring clamp which comprises an inwardly opening channel-form ring formed of polymeric material, having a fast end with oppositely disposed side surfaces and an outwardly extending rearwardly opening pivot shaft receiving notch. The ring includes an oppositely disposed second end including a receiver channel having oppositely disposed spaced-apart sides defining an opening. The spaced-apart sides of the receiver channel have mutually inwardly facing internal surfaces which are slideably movable in adjacency over the side surfaces of the first end. The receiver channel further includes a ring pivot shaft extending between the spaced-apart sides forwardly of the opening. A pivot arm is provided having a pivot end with a transversely disposed arm pivot shaft. The arm further includes a ring pivot shaft receiving notch having an outwardly disposed shaft access opening of predetermined extent extending to a shaft bearing surface a distance selected for drawing together the ring first and second ends. The arm pivot shaft is configured for slideable engagement with the ring first end pivot shaft receiving notch and the ring shaft receiving notch is configured for slideably receiving the second end ring pivot shaft.

As another feature, the invention provides, in a container assembly wherein a cylindrically shaped polymeric container is provided having a bottom and side walls extending therefrom to a top portion including a rim structure with an upwardly disposed rim edge, an outwardly disposed side surface portion, and an inwardly extending engaging region having an upper contact surface, and wherein a polymeric lid is provided having a circular peripheral portion positioned over the rim edge in nesting, container closing fashion, the improved split ring clamp for retaining the lid upon the rim structure which includes an inwardly opening, channel-form split ring formed of polymeric material. The split ring has oppositely disposed sides and a top, one of the sides being positionable in abutting adjacency against the upper contact surface and the opposite side thereof being positionable in abutting adjacency against the lid peripheral portion. The split ring has a first end with a first toe outwardly extending from the top, that first toe having a rearwardly disposed first contact surface. The first end further includes an outwardly extending rearwardly opening pivot shaft receiving notch which is integrally formed therein. The ring has an oppositely disposed second end including an integrally formed receiver channel having oppositely disposed spaced apart sides defining an opening. These spaced apart sides have mutually inwardly facing internal surfaces which are slideably movable in adjacency over the sides at the first end of the ring. The receiver channel includes an inwardly depending second toe with a rearwardly facing second contact surface configured in correspondence with the first contact surface. The second end receiver channel includes a ring pivot shaft extending between the spaced apart sides. Additionally provided is a pivot arm formed of polymeric material which has a pivot end with a transversely disposed arm pivot shaft and a ring pivot shaft receiving notch. The ring pivot shaft receiving notch has an outwardly disposed shaft access opening of predetermined dimensional extent which extends to a shaft bearing surface. The shaft bearing surface is spaced from the arm pivot shaft a distance selected for drawing together the ring first and second ends to an extent effective to cause an abutting, stress transfer engagement of the first contact surface with a second contact surface to effect securement of the lid upon the rim structure, the arm extending therefrom to form a lever. The arm pivot shaft is configured for pivotal engagement with the first end pivot shaft receiving notch and the ring shaft receiving notch is configured for slideably receiving the second end ring pivot shaft.

Another feature of the invention provides a split ring clamp which comprises an inwardly opening, channel-form ring formed of polymeric material, having a first end with oppositely disposed side surfaces and an outwardly extending rearwardly opening pivot shaft receiving notch. The ring has an oppositely disposed second end which includes a receiver channel having oppositely disposed spaced apart sides defining an opening. These spaced apart sides have mutually inwardly facing internal surfaces which are slideably movable in adjacency over the side surfaces at the first end and includes a ring pivot shaft extending between the spaced apart sides forwardly of the opening. A latch component formed integrally with and extending outwardly from the first end is located rearwardly of the pivot shaft receiving notch and extends outwardly to a latch tip. The latch component has a locking aperture extending therethrough. A pivot arm is provided having a pivot end with a transversely disposed arm pivot shaft, a ring pivot shaft receiving notch having an outwardly disposed shaft access opening of predetermined extent. This receiving notch extends to a shaft bearing surface a distance selected for drawing together the ring first and second ends. The pivot arm extends from the shaft access opening to form a lever portion having an outwardly disposed surface. The arm pivot shaft is configured for slidably engagement with the ring first end pivot shaft receiving notch. The ring shaft receiving notch is configured for slidably receiving the second end ring pivot shaft. The lever portion is formed having an opening extending through the outwardly disposed surface and a ledge adjacent the opening. A keyway extends across the pivot arm at the opening having a detent formed therein. The latch tip engages the ledge and the keyway is in alignment with the aperture when the pivot arm is in a closed orientation. A locking key is provided which is configured for insertion within the keyway through the aperture and across the opening and has a pawl engageable with the detent when the key is inserted within the keyway.

Other objects and features of the invention will, in part, be obvious and will, in part, appear hereinafter.

The invention, accordingly, comprises the apparatus possessing the construction, combination of elements, and arrangement of parts which are exemplified in the following detailed disclosure.

For a fuller understanding of the nature and objects of the invention, reference should be had to the following detailed description taken in connection with the accompanying drawings.

DETAILED DESCRIPTION

Figure 1:
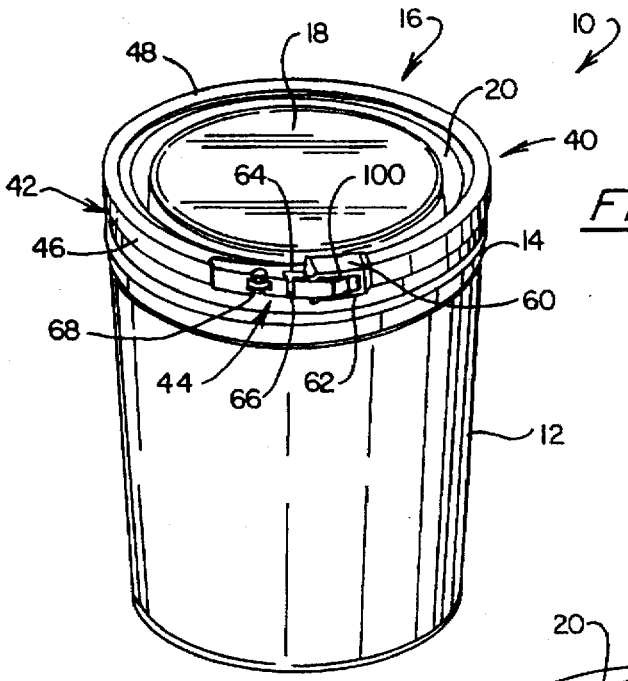
FIG. 1 is a perspective view of a plastic drum type container and lid assembly utilizing a two-piece ring clamp closure according to the invention.

Referring to FIG. 1, an assembly comprised of a drum-type container of a plastic variety, a lid and an enclosing split ring clamp fashioned according to the principal embodiment of the invention is revealed generally at 10. The drum component of the assembly 10 as shown at 12 typically will be blow molded or injection molded and configured such that the side walls slightly taper inwardly toward the drum bottom and the bottom surface is configured with a slight upward bow both to enhance the searing on a surface and to avoid downward flexure. The upper portion of drum 12 is configured having an integrally formed, outwardly disposed truncated channel region 14 which strengthens and thus enhances retention of the circular stature of its top edge. Generally, no metal chimes or the like as may be found with fiber drums are present in the plastic drum construction. Drum 12 is shown to be closed by a lid represented generally at 16 which, for the instant assembly, is formed of a plastic material, for example, such as an integrally molded polyolefin.

Figure 2:
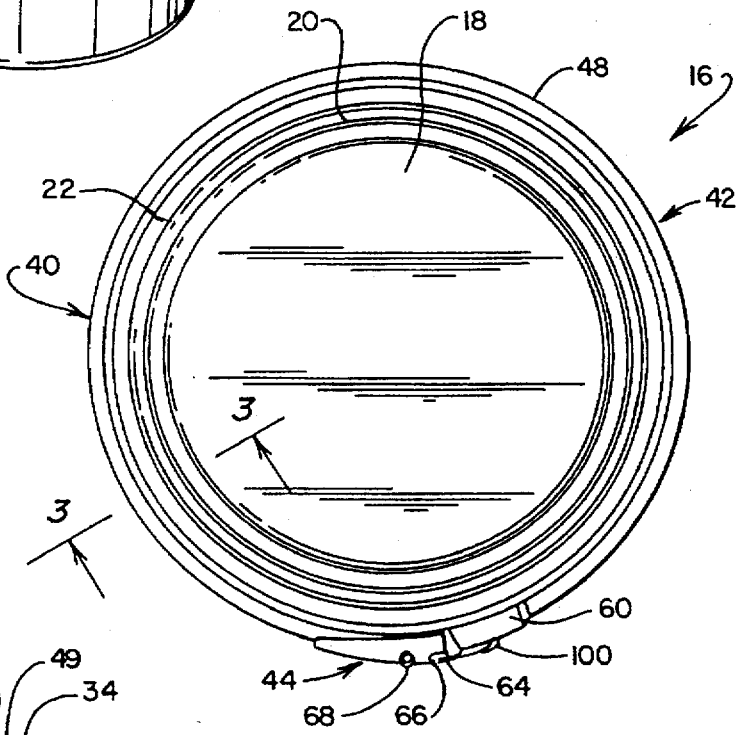
FIG. 2 is a top view of the assembly of FIG. 1.
Figure 3:
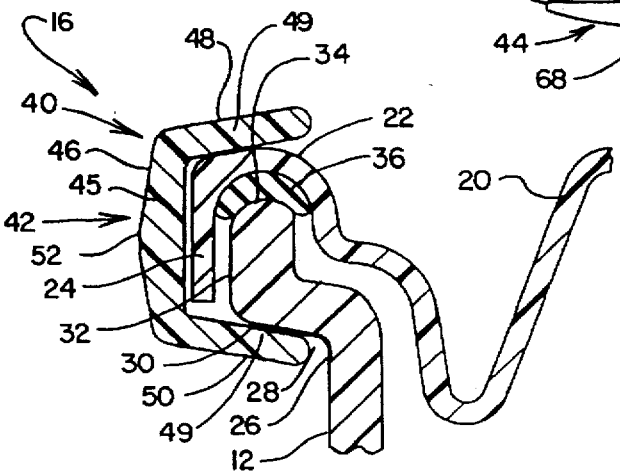
FIG. 3 is a partial sectional view taken through the plane 3—3 in FIG. 2.

Looking additionally to FIGS. 2 and 3, lid 16 is seen to be formed having a fiat upper surface 18 which transitions to define an annular undulation or accordian-like structure 20 which extends upwardly to an annular lid rim 22 which then extends outwardly and downwardly to form a lid skirt seen in FIG. 3 at 24.

Lid 16 is depicted as being of somewhat conventional structuring. A preferred lid structure for use with plastic drums is described in a copending application for United States patent entitled "Molded Lid with Wave Configured Central Portion" by Bordner, et al., filed May 2, 1996 Ser. No. 08/643,236 and assigned in common herewith.

The rim structure of the drum 12 is shown in general at 26. Structure 26 is integrally configured with the drum and includes an inwardly extending engaging region or groove 28 having an upper contact surface 30. Rim structure 26 further is configured to define a side surface portion 32 which extends upwardly in encircling fashion to develop an upwardly disposed rim edge 34. The underside of the annular lid rim 22 is seen to be nested over rim edge 34 and intermediate those components is a flexible gasket 36 formed of rubber or suitable polymer. Rim structures as at 26 will vary depending upon the particular drum manufacture. In general, however, all will include the structuring for providing some form of upper contact surface 30 and will extend upwardly to provide an upwardly disposed rim edge as at 34.

Lid 16 is secured to the rim structure 22 of the drum 12 by a two-piece split ring clamp represented generally at 40.

In general, the clamp assembly 40 includes a ring shown generally at 42 and, as revealed in connection with FIGS. 1 and 2, a pivot arm represented generally at 44. Ring 42 is formed of polymeric material, for example, a high molecular weight, high density polyethylene copolymer such as type HYA-24 marketed by Mobil Polymers U.S., Inc. The material exhibits excellent impact strength and stress crack resistance suited for high performance tank and drum applications. For added integrity and endurance under adverse sun conditions, the material may incorporate a U.V. (ultraviolet) screen. Pivot arm component 44 is configured both to exhibit an enhanced strength with respect to requisite international drop tests and the like as well as an enhanced profile. In the latter regard, the structure of pivot arm 44 is such as to be more conforming or thinner with respect to the outer periphery of the drum-lid assembly 10. Preferably, pivot arm 44 is formed of a polymeric material such as an opaque acrylic-polycarbonate alloy marketed, for example, under the trade designation CYREC ®200 by CYRO Industries of Mt. Arlington, N.J.

FIG. 3 shows the ring component 42 of the clamp 40 to have a generally channel-shaped configuration with an outer band portion 45, in turn, having an outward surface 46 formed integrally with oppositely disposed spaced sides 47 and 49 with respective side surfaces 48 and 50. To improve the tensile strength of ring 42, the center of band 45 may be formed with an enhanced thickness to define a ridge 52.

FIGS. 1 and 2 reveal certain components of the clamp 40 which are discussed in detail later herein. In this regard, one end of the ring 42 includes an integrally formed receiver channel 60 having an opening formed therein at 62 which is seen in FIG. 1. Pivot arm 44 includes a ring pivot shaft receiving notch 64 having an outwardly accessible shaft access opening 66. A locking detent assembly is shown generally at 68 which serves the purpose of retaining the pivot arm 44 in its closed orientation. The detent assembly 68 also is configured so as to receive a lock or the like to assure the integrity of the materials which may be contained in the drum assemblage 10. It will be observed to be configured so as to be contained substantially within the profile of pivot arm 44 when in a closed or locked orientation as seen in FIG. 2. This is one aspect of the more desirable thin profile of the clamp assembly 40. An alternate and preferred embodiment for a locking detent assembly is described in conjunction with FIGS. 16–18 at 200.

Figure 4:
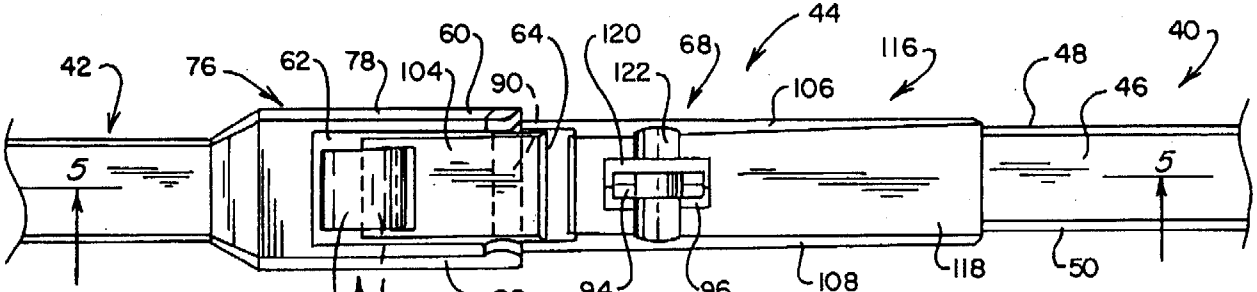
FIG. 4 is a partial side view of the two-piece split ring clamp of the invention showing the pivot arm thereof.
Figure 5:
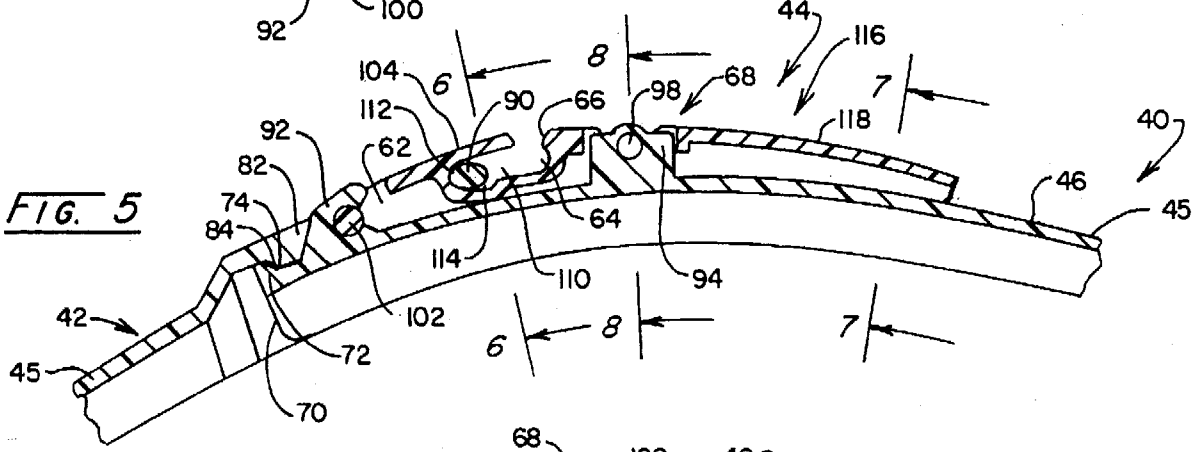
FIG. 5 is a sectional view taken through the plane 5—5 in FIG. 4.
Figure 6:
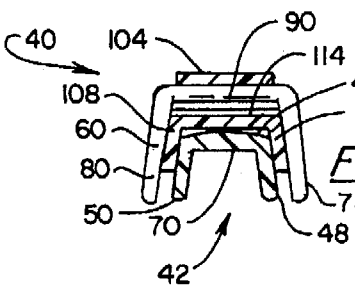
FIG. 6 is a sectional view taken through the plane 6—6 shown in FIG. 5.

Referring to FIGS. 4 and 5, the structure of split ring 42 and associated pivot arm 44 are revealed at a higher level of detail. Ring 42 is seen to have a first end represented generally at 70 (FIG. 5). Integrally formed at this first end or end region 70 is an outwardly extending toe 72 (FIG. 5) with a rearwardly extending contact surface 74. The term "rearwardly" as used herein is considered to be in the direction toward an opposite end of the ring 42 from one or the other end, for example, end 70. The second end of split ring 42 is represented generally at 76 and is seen to include the above-noted integrally formed receiver channel 60 and its associated opening 62 (FIG. 4). Receiver channel 60 is seen in FIGS. 4 and 6 to include spaced apart sides 78 and 80 which function to define the opening 62 and which, as seen in FIG. 6, have mutually inwardly facing internal surfaces which are slideably movable in adjacency over the side surfaces 48 and 50 at first end region 70 of the ring 42. FIG. 5 reveals that the receiver channel 60 includes an integrally formed inwardly depending toe 82 which is rearwardly disposed from the opening 62 and which includes a rearwardly facing second contact surface 84. FIG. 5 shows a closed orientation for the clamp 40 such that the contact surfaces 74 and 84 are seen to be in mutual abutment. The toes 72 and 82 extend across first and second ends 70 and 76, and the contact surfaces 74 and 84 are in a stress transfer relationship such that the toes 72 and 82 carry a substantial portion of tensile stress asserted by the clamp 40 when closed about a drum in the manner of FIG. 1. This relieves stress at more fragile regions associated with the pivot arm 44. Note that the contact surfaces 74 and 84 are slightly canted for the purpose of facilitating their engagement during the closing procedure associated with developing clamping and are substantially aligned with band 45. In this regard, surface 74 is canted outwardly and forwardly, while surface 84 is canted inwardly and forwardly. The term "forwardly" as used herein is considered to be in the direction away from an opposite end of the ring 42 and applies to either end of such ring.

As seen in FIGS. 4 and 5, sides 78 and 80 of receiver channel 60 extend forwardly to support a ring pivot shaft 90 which is seen in FIGS. 5 and 6 to be located outwardly at the tip of the receiver channel 60. FIG. 5 reveals that the ring pivot shaft 90 is non-circular in cross-section, being shown having an oval or elipse shape with the principal dimension being aligned with the direction of tensile stress experienced by the clamp 40 and, in particular with band portion 45 thereof. This improves the strength of the clamp in that direction of principal stress and also will be seen to provide an improved capture of the component within the pivot arm 44.

Returning to the tip region 70 of split ring 42, FIGS. 4 and 5 reveal an outwardly extending, rearwardly opening pivot shaft receiving notch 92 which is integrally formed rearwardly of the outer tip of first end 70 of ring 42. That tip portion 70 also carries an integrally formed dog or latch component 94 which extends upwardly from the outer surface 46 to engage a recessed ledge seen in FIG. 4 at 96 when the clamp 40 is in a closed orientation. Note that the latch component 94 is formed having a circular opening 98 formed therein for the purpose of permitting passage of a locking component such as a lock, heavy wire, or the like. FIG. 5 reveals that the latch component 94 does not extend excessively outwardly but completes a latching function with the recessed ledge 96 (FIG. 4) well within the overall profile of the pivot arm 44. This contributes to the noted desirably thinner profile for the assembly.

Now looking to the structure of the pivot arm 44, it may be observed that the arm is formed having a pivot end represented generally at 100 which supports integrally formed, transversely disposed arm pivot shaft 102. Shaft 102 is pivotally engaged within pivot shaft receiving notch 92. Pivot arm 44 is formed of the noted polymeric material in somewhat of a channel form having an upper surface 104 and sides 106 and 108 as seen in FIGS. 4 and 6. Spaced from the arm pivot shaft 102 is the earlier described ring pivot shaft receiving notch 64 with associated shaft access opening 66. Note that the opening 66 is located at the outward surface 104 of pivot arm 44, a feature contributing to the lower or thin profile of the arm 44 based latching function. This feature also provides an enhancement for expansion of the size of sides 106 and 108 of the arm 44, an arrangement substantially improving its stiffness against flexure when clamp 40 is being opened or closed. By contrast, where the access opening as at 66 is located on the inward side of the pivot arm, then enhancement of the strength of the arm in that region is only available at the cost of a less desirable outwardly extending oval profile. FIG. 5 reveals that the shaft access opening 66 is of lesser widthwise extent than the principal dimension of ring pivot shaft 90. As such, shaft 90 must be oriented with its principal dimension relatively perpendicular with respect to the receiving notch 64 in order to readily be removed or inserted. Notch 64, in turn, is configured having an entrance channel as seen in FIG. 5 at 110 which also is of outwardly disposed dimensional extent less than the noted shaft 90 principal dimension. Thus, the shaft 90 may slide within entrance channel 110 when it is in the orientation shown in the figure. Entrance channel 110 extends to a shaft bearing surface 112 which, in the closed orientation shown in FIG. 5, functions to compressively abut against one side of shaft 90. The shaft 90, however, may change its relative orientation with respect to channel 110 by virtue of the enlargement of the outwardly disposed dimension of the channel in the vicinity of shaft 90 as shown as an entrance channel enlargement region 114. The shift bearing surface 112 is spaced from the arm pivot shaft 102 a distance selected for drawing together the first and second ends of the split ring 42 to an extent effective to cause the abutting, stress transfer engagement of the earlier-noted contact surfaces 74 and 84 as the clamp 40 is closed.

Figure 8:
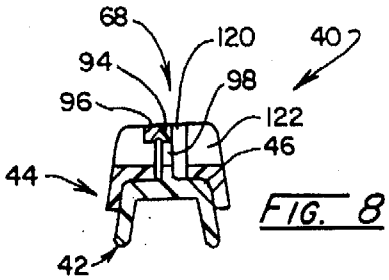
FIG. 8 is a sectional view taken through the plane 8—8 shown in FIG. 5.

Pivot arm 44 extends from notch 64 to form a lever portion represented generally at 116. Within this lever portion 116, the locking detent assembly 68 is completed with the provision of a rectangular opening 120 extending through the outer surface 118 as well as the provision of a transversely disposed cylindrically shaped circular opening or cylindrical channel 122. Additionally, within this opening 120, the noted recessed ledge 96 is formed as seen in FIGS. 4 and 8. With the arrangement shown, when the pivot arm 44 is fully closed, the circular openings of latch 94 and arm 44 are aligned for receiving some form of locking rod or wire. As noted above, the desirably narrower profile for arm 44 also is achieved.

Figure 7:
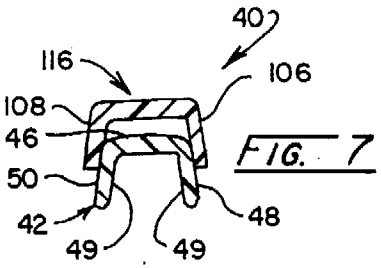
FIG. 7 is a sectional view taken through the plane 7—7 shown in FIG. 5.

FIG. 7 reveals that the outer sides of the lever portion 116 as at 106 and 108 are slightly outwardly canted and nest over the outer surfaces 48 and 50 of split ring 42 when in the closed orientation of FIG. 5.

Figure 11:
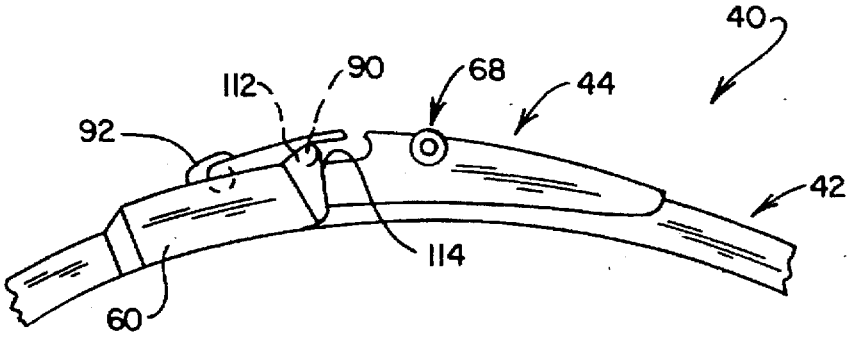
FIG. 11 is a partial side view of the clamp of FIG. 9 showing it in a closed orientation.
Figure 10:
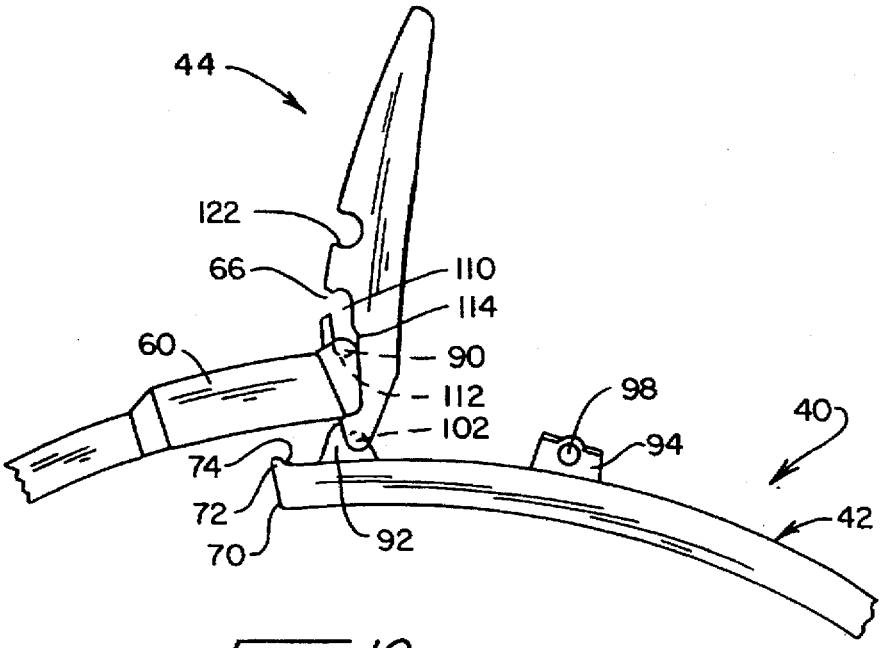
FIG. 10 is a partial side view of the clamp of FIG. 9 showing its orientation while being closed.
Figure 9:
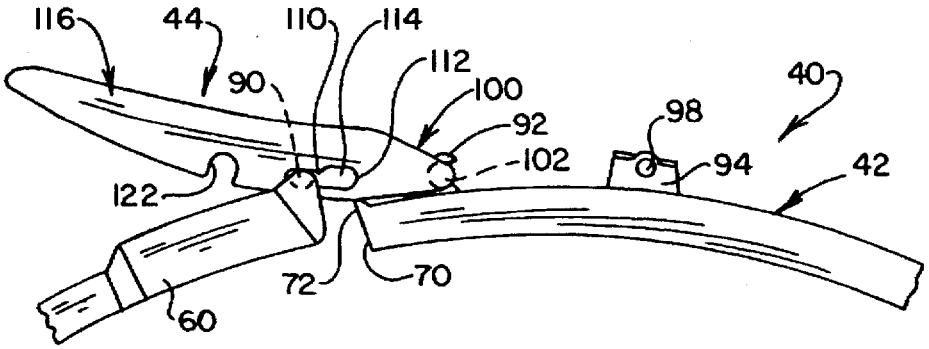
FIG. 9 is a partial side view of the two-piece split ring clamp of the invention, showing an open orientation thereof.

FIGS. 9–11 illustrate the orientations of the components of the clamp 40 when manipulated from an open to a closed orientation. FIG. 9 reveals the orientation of the clamp 40 generally assumed during the procedure for installing it upon the rim-lid interface of a drum assembly 10. The figure shows that the arm pivot shaft 102 has been inserted within the pivot shaft receiving notch 92. This insertion will involve a resilient give or deformation on the part of the notch 92 so as to, in effect, capture the shaft 102. Oval shaped ring pivot shaft 90 will have been inserted through shaft access opening 66 and into entrance channel 110 by elevating the pivot arm 44 towards the orientation shown in FIG. 10 such that the dimension of shaft 90 normal to its principal dimension confronts the opening 66. The pivot arm 44 then can be returned to the orientation of FIG. 9 to permit maximum opening circumference of the ring clamp 40. However, because of its orientation shown in FIG. 9, the oval shaped ring pivot shaft 90 is captured within the entrance channel 110. As the pivot arm 44 is rotated about shaft 102 to the orientation shown in FIG. 10, the ring pivot shaft 90 will slide along entrance channel 110 toward entrance channel enlargement region 114 to thus become seated against shaft bearing surface 112 as seen in FIG. 10. Receiver channel 60 is now elevated and is moving forwardly with respect to first end 70. As this motion continues, the toe 72 contact surface 74 will move into engagement with the corresponding contact surface 84 of toe 82 formed within receiver channel 60 as described in connection with FIG. 5. This union occurs with full closure of the pivot arm 44 as seen in FIG. 11. Note in the latter figure that the relative orientation of oval shaped ring pivot shaft 90 is now that depicted in FIG. 5 with one side thereof being in compressive contact with shaft bearing surface 112 of entrance channel enlargement portion 114.

Figure 12:
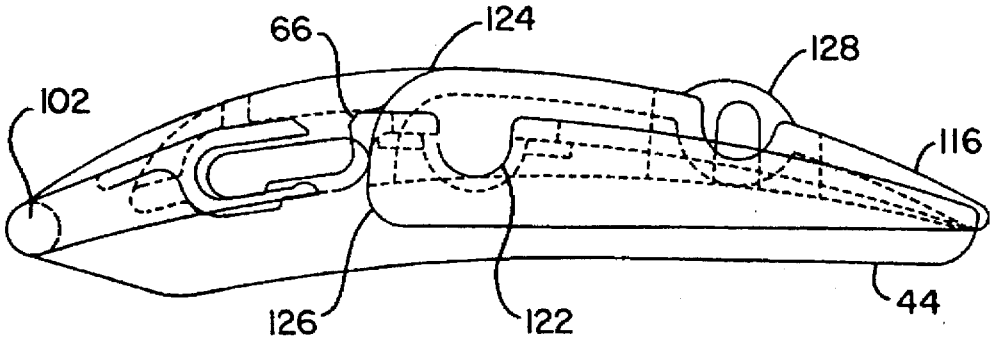
FIG. 12 is a top view superimposing the pivot arm component of the present invention over the pivot arm of the two piece plastic ring clamp of the prior art revealing profile differences.

The lower profile achieved with pivot arm 44 as compared with the corresponding pivot arm described in connection with the above-noted U.S. Pat. No. 5,129,537 is revealed in conjunction with FIG. 12. In FIG. 12, the present arm 44 is shown in solid line fashion as extending from arm pivot shaft 102 to the lever portion 116. This view is superimposed upon the outline of the corresponding prior an pivot arm. Note that the profile is thinner while an enhanced strength is achieved in the arm in the region of the shaft access opening 66. In the figure, the arm pivot shaft 102 is coincident with the corresponding arm pivot shaft of the arm shown generally in phantom at 124. Opening 66 is seen to be aligned with the corresponding inwardly disposed opening 126 of arm 124. Opening 122 for receiving latch component 94 is recessed within the arm 44 while the corresponding latch of the arm 124 extends upwardly as seen at 128.

Figure 13:
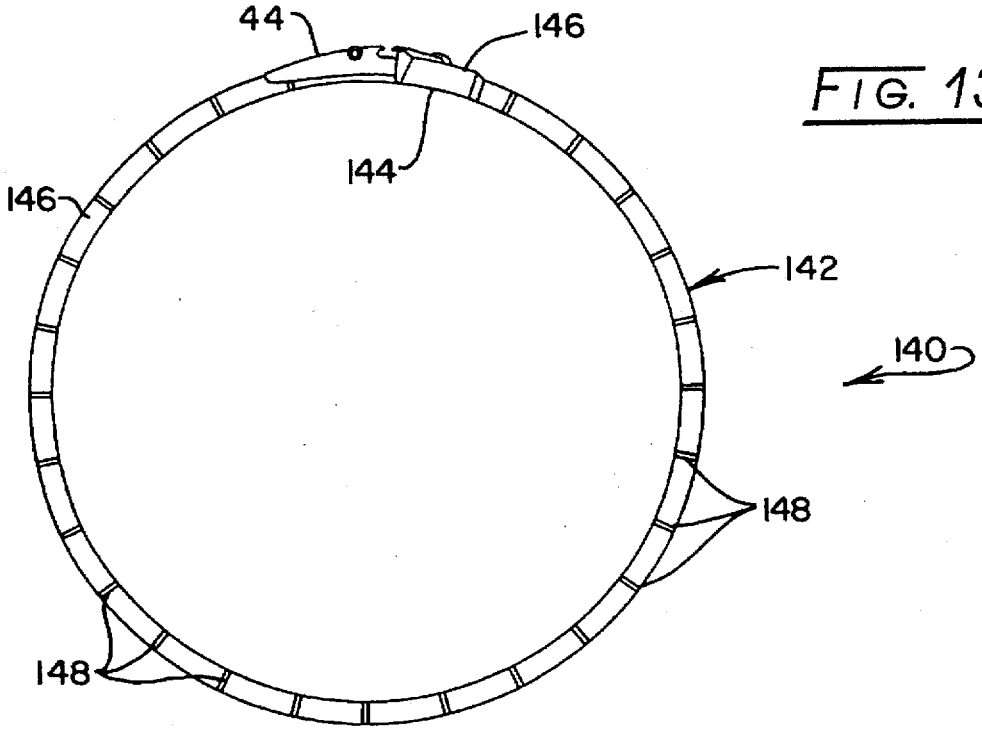
FIG. 13 is a bottom view of another embodiment of the two-piece ring clamp of the invention illustrating a reinforcing fib structuring.
Figure 14:
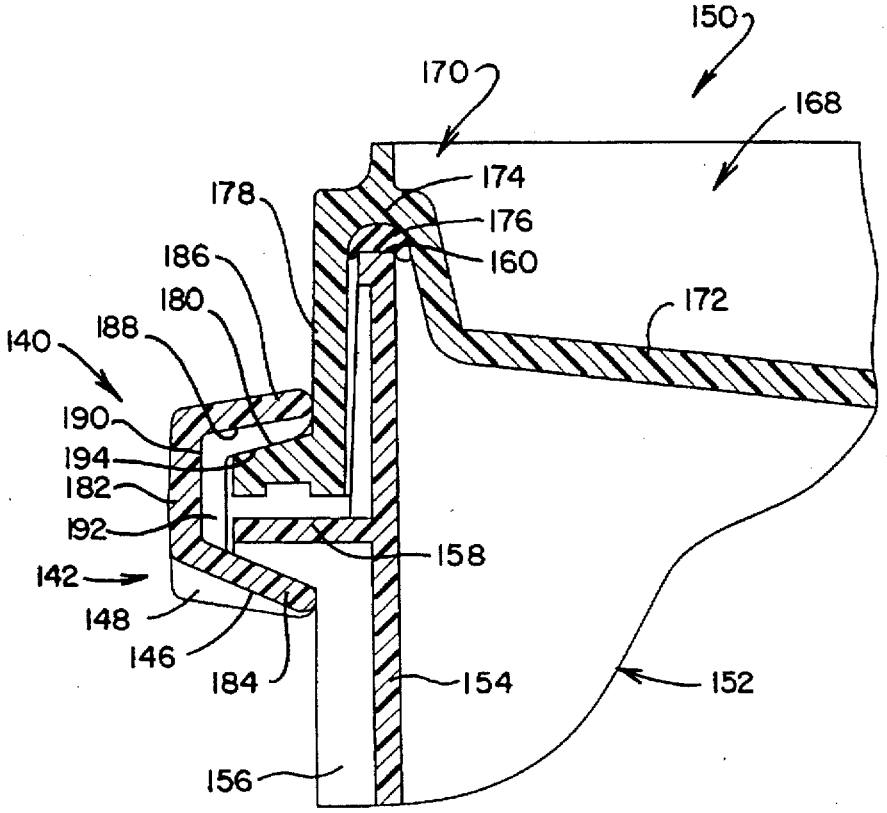
FIG. 14 is a partial sectional view similar to FIG. 3 showing a plastic drum configuration with closing plastic lid and a sectional view of the split ring clamp of FIG. 10.
Figure 15:
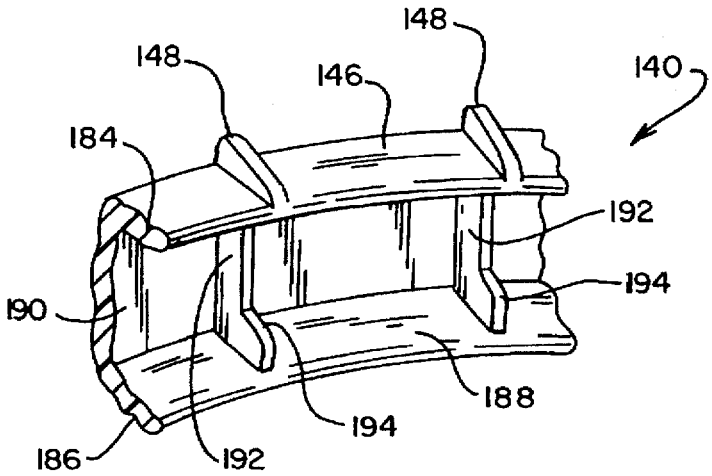
FIG. 15 is a partial perspective view of the embodiment of FIG. 10 showing the underside in an upward orientation for clarity.

An alternate embodiment for the ring component of the clamp 40 is represented in connection with FIGS. 13–15. This two-piece split ring clamp is represented in FIG. 13 in general at 140. For the purpose of illustration, clamp assembly 140 in FIG. 13 is shown looking toward its underside. The assembly 140 includes a pivot arm 44 structured identically with that heretofore discussed and is illustrated with the same numeration. The pivot arm 44 performs in conjunction with a ring 142 formed of the same polymeric material as ring 42 and having a first end at the location shown at 144 which is inserted within a receiver channel 146 structured identically as that described at 60 above. The normally downwardly disposed surface of ring 142 as shown at 146, however, is configured having a plurality of regularly radially spaced outer rib components, certain of which are identified at 148 which extend downwardly from side 146.

Looking additionally to FIG. 14, a sectional view of a container assembly represented generally at 150 is provided. This assembly includes a polymeric drum 152 having a sidewall 154 with a sequence of regularly spaced vertical polymeric ribs integrally formed and extending outwardly therefrom, one of which is shown at 156. The ribs as at 156 extend to a continuous annular ledge 158 depending outwardly and integrally formed with the wall 154. Wall 154 also is seen to extend upwardly to a rim edge 160.

Positioned over the drum 152 is a polymeric lid represented generally at 168 having an a peripheral portion 170 extending from a central region 172 to a lid rim 174 containing a flexible gasket 176 and continuing to a lid skirt 178 having an outwardly extending ledge component 180. In the figure, the ring 142 of clamp assembly 140 is shown having outwardly disposed band portion 182 along with a normally downwardly disposed side 184 with the noted normally downwardly disposed surface 146. Disposed oppositely from the side 184 is a normally upwardly disposed side 186. This side 186 is configured having a side interior surface 188, while the band portion 182 is shown having a band interior surface 190. As seen in FIGS. 14 and 15, the interior or inwardly facing side of the ring 142 includes a sequence or plurality of regularly radially spaced inner rib components 192 integrally formed with and extending outwardly from the band interior surface 190 and the side interior surface 188. In particular, these spaced interior ribs form radially spaced apart abutting edges as at 194 which are seen to contact the lid 168 peripheral portion 170 at the ledge 180. This provides a point-to-point contact with the side periphery 170. Note that the interiorly disposed ribs 192 are aligned with those extending downwardly at 148. In general, the regularly spacing arrangement extends from the first and second ends of the ring 142, a typical radial spacing being at about 10°.

In general, split ring clamps of the type described have either a "right hand" sense or a "left hand" sense to the extent that, upon installing them upon a drum-lid assembly, it is desirable that the normally downwardly disposed side, indeed, be downwardly disposed. The embodiments illustrated above are fashioned in a "right hand" sense. By locating the rib components 148 at the normally downwardly disposed side of the ring 142, the user is given a very helpful visual as well as tactile cueing for assuring proper ring orientation.

Figure 16:
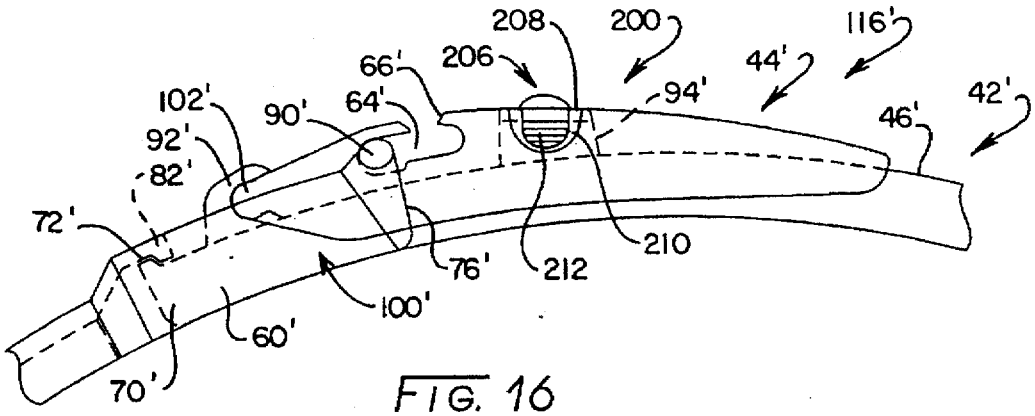
FIG. 16 is a partial side view of the clamp of the invention similar to that shown in FIG. 11 but illustrating a locking key and keyway embodiment.
Figure 17:
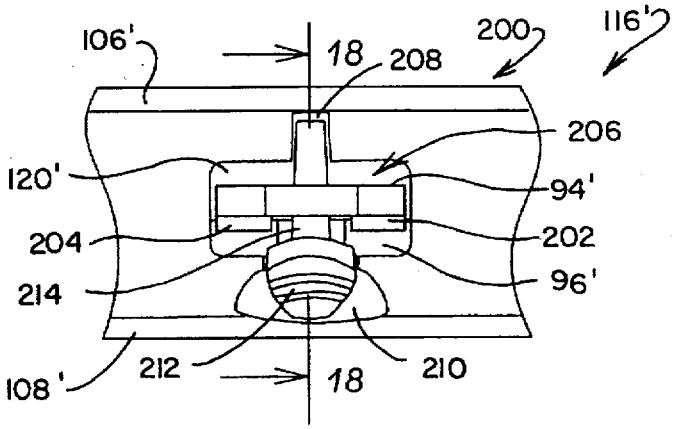
FIG. 17 is a partial top view of the clamp of FIG. 16.
Figure 18:
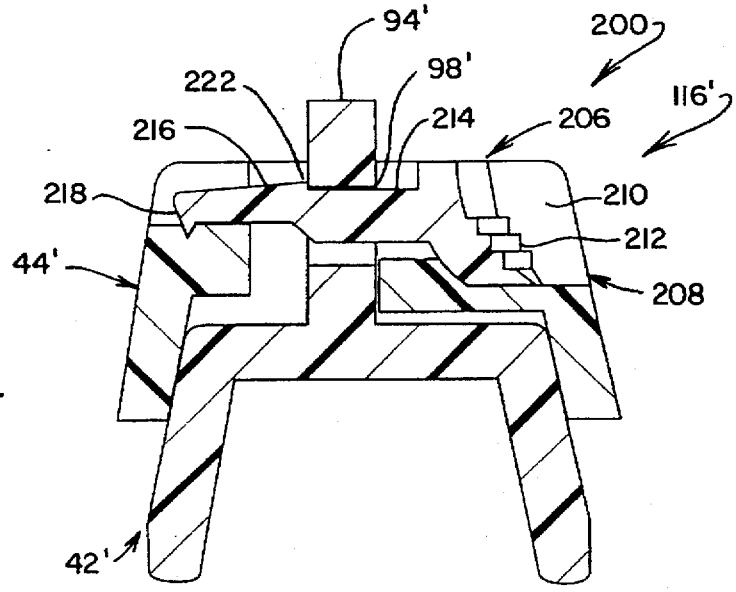
FIG. 18 is a sectional view taken through the plane 18—18 seen in FIG. 17.

Referring to FIGS. 16–18, a preferred locking detent assembly 200 is revealed. To facilitate this structuring as it relates to the split ring clamp 42, the earlier-described component of the channel form ring 42 and the pivot arm 44 are retained but in primed fashion. Locking detent assembly 200 employs the earlier-described latching component 94 as it cooperates in latching fashion with ledge 96. In this regard, it may be seen in FIG. 17 that latching component 94' is configured having a latching tip with latch protrusion shown at 202 and 204 which engage the ledge 96' within the opening 120'. With the present embodiment, this engagement of components 202 and 204 with ledge 96' is enhanced or buttressed through the utilization of a locking key shown generally at 206. Key 206 is configured for insertion through the opening 98' within latch 94'. It is manually inserted in the assembly through a keyway 208 formed in the lever portion 116' of pivot arm 44'. FIGS. 16 and 17 show that the keyway 208 is splayed outwardly at 210 so as to cooperate with a fingertip conforming surface 212 of the locking key 206. This arrangement substantially facilitates the insertion of the locking key 206 within the keyway 208. FIG. 18 shows that the key 206 is formed having an upwardly disposed searing surface 214 which extends to a ramp surface 216, in turn extending to a pawl 218. When the locking key 206 is inserted within keyway 208, the ramp 216 slides beneath and in contact with the top of aperture 98' until the pawl 218 engages a detent 220 within the lever portion of the pivot arm 44'. As this occurs, a stop surface 222 defining transition from ramp 216 and surface 214 engages one side of the top of latch 94' to urge latching component 202 and 204 (FIG. 17) into a more assured engagement with ledge 96'. Additionally, the locking key 206 itself assures a retention of the pivot arm 44' in a closed orientation. The locking feature is released by the user at the time of lid removal by accessing locking pin 206 through the opening 120' with wire cutters or the like.

Since certain changes may be made in the above apparatus without departing from the scope of the invention herein involved, it is intended that all matter contained in the above description or shown in the accompanying drawings shall be interpreted as illustrative and not in a limiting sense.

We claim:

1. A split ring clamp for retaining a lid upon the rim of a container at the interface therebetween, comprising:

an inwardly opening channel-form ring formed of polymeric material, having first and second oppositely disposed ends, said first end having oppositely disposed side surfaces, having an outwardly extending toe with a first contact surface rearwardly disposed toward said second end, and an outwardly extending pivot shift receiving notch opening rearwardly toward said second end, said ring oppositely disposed second end including a receiver channel having oppositely disposed spaced apart sides defining an opening, said spaced apart sides having mutually inwardly facing internal surfaces slidably movable in adjacency over said side surfaces at said first end, said receiver channel including an inwardly depending toe with a second contact surface rearwardly facing toward said first end configured in correspondence with said first contact surface, said second end receiver channel including a ring pivot shaft extending between said spaced apart sides forwardly of said opening; and pivot arm having a pivot end with a transversely disposed arm pivot shaft, a ring pivot shaft receiving notch having a shaft access opening extending to a shaft bearing surface spaced from said arm pivot shaft a distance selected for drawing together said ring first and second ends to an extent effective to cause an abutting, stress transfer engagement of said first contact surface with said second contact surface, and extending therefrom to form a lever having an outwardly disposed surface, said arm pivot shaft being configured for pivotal engagement with said ring first end pivot shaft receiving notch, and said ring pivot shaft receiving notch being configured for slidably receiving said second end ring pivot shaft.

2. The split ring clamp of claim 1 in which: said pivot arm is formed of polymeric material; and said arm pivot shaft is formed integrally with said pivot arm.

3. The split ring clamp of claim 1 in which:

said pivot arm lever is formed having a slot extending therethrough including a ledge formed therein at a location inwardly disposed from said outer surface; and including a latch component formed integrally with and extending outwardly from said channel form ring first end to a latch tip an extent sufficient to engage with said ledge without extending outwardly from said pivot arm outwardly disposed surface.

4. The split ring clamp of claim 1 in which said outwardly extending toe, said pivot shaft receiving notch, said receiver channel, said inwardly depending toe and said ring pivot shaft are formed integrally with said ring.

5. The split ring clamp of claim 4 in which said inwardly depending toe of said receiver channel is disposed rearwardly toward said first end from said opening.

6. The split ring clamp of claim 1 in which said inwardly opening channel form ring is configured having an outwardly disposed band portion and an integrally formed normally upwardly disposed side and an integrally formed normally downwardly disposed side providing said oppositely disposed side surfaces between said first and second ends; and including a plurality of regularly radially spaced outer rib components extending downwardly from said normally downwardly disposed side.

7. The split ring clamp of claim 6 in which:

said inwardly opening channel form ring band portion includes a band interior surface and said normally upwardly disposed side includes a side interior surface extending from said band interior surface; and including a plurality of regularly radially spaced inner rib components integrally formed with and extending outwardly from said band interior surface and said side interior surface to provide radially spaced apart abutment edges.

8. A split ring clamp, comprising:

an inwardly opening, channel-form ring formed of polymeric material, having first and second oppositely disposed ends, said first end, having oppositely disposed side surfaces and an outwardly extending pivot shaft receiving notch rearwardly opening toward said second end, said ring oppositely disposed second end including a receiver channel having oppositely disposed spaced apart sides defining an opening, said spaced apart sides having mutually inwardly facing internal surfaces slideably movable in adjacency over said side surfaces at said first end and including a ring pivot shaft extending between said spaced apart sides forwardly of said opening; and a pivot arm having a pivot end with a transversely disposed arm pivot shaft, a ring pivot shaft receiving notch having an outwardly disposed shaft access opening of predetermined dimensional extent extending to a shaft bearing surface a distance selected for drawing together said ring first and second ends, said arm pivot shaft being configured for slidable engagement with said ring first end pivot shaft receiving notch, and said ring shaft receiving notch being configured for slideably receiving said second end ring pivot shaft.

9. The split ring clamp of claim 8 in which said ring pivot shaft is configured having a non-circular cross-section with a principal dimension of extent larger than the said predetermined dimensional extent of said shaft access opening.

10. The split ring clamp of clam 9 in which said ring pivot shaft is formed integrally with said ring and said cross section is oval shaped.

11. The split ring clamp of claim 9 in which said ring pivot shaft receiving notch includes an entrance channel extending toward said pivot end and transitioning to an entrance channel enlargement portion adjacent said shaft bearing surface and dimensioned in correspondence with said ring pivot shaft principal dimension to permit pivotal movement of said ring pivot shaft relative to said shaft bearing surface.

12. The split ring clamp of claim 11 in which said shaft cross section is oval shaped.

13. The split ring clamp of claim 9 in which:

said ring first end includes an outwardly extending toe with a first contact surface rearwardly disposed toward said second end;

said ring receiver channel includes an inwardly depending toe with a second contact surface rearwardly facing toward said first end configured in correspondence with said first contact surface; and said shaft bearing surface is spaced from said arm pivot shaft a distance selected for drawing together said ring first and second ends to an extent effective to cause an abutting stress transfer engagement of said first contact surface with said second contact surface.

14. The split ring clamp of claim 13 in which said inwardly depending toe or said receiver channel is disposed rearwardly toward said first end front said opening.

15. In a container assembly wherein a cylindrically shaped polymeric container is provided having a bottom and side walls extending therefrom to a top portion including a rim structure with an upwardly disposed rim edge, an outwardly disposed side surface portion and an inwardly extending engaging region having an upper contact surface, and wherein a polymeric lid retainable upon said rim structure with a split ring clamp is provided having a circular peripheral portion positioned over said rim edge in nesting, container closing fashion, the improved split ring clamp for retaining said lid upon said rim structure, comprising:

an inwardly opening, channel-form split ring formed of polymeric material, having oppositely disposed sides and a top, one of said sides being positionable in abutting adjacency against said upper contact surface and the side opposite thereof being positionable in abutting adjacency against said lid peripheral portion, said ring having first and second oppositely disposed ends, said first end having a first toe outwardly extending from said top, said first toe having a first contact surface rearwardly disposed toward said second end, and an outwardly extending pivot shaft receiving notch rearwardly opening toward said second end integrally formed therein, said ring oppositely disposed second end including an integrally formed receiver channel having oppositely disposed spaced apart sides defining an opening, said spaced apart sides having mutually inwardly facing internal surfaces slideably movable in adjacency over said sides at said first end, said receiver channel including an inwardly depending second toe with a second contact surface rearwardly facing toward said first end configured in correspondence with said first contact surface, said second end receiver channel including a ring pivot shaft extending between said spaced apart sides; and a pivot arm formed of polymeric material, having a pivot end with a transversely disposed arm pivot shaft, a ring pivot shaft receiving notch having an outwardly disposed shaft access opening of predetermined dimensional extent extending to a shaft bearing surface spaced from said arm pivot shaft a distance selected for drawing together said ring first and second ends to an extent effective to cause an abutting stress transfer engagement of said first contact surface with said second contact surface to effect securement of said lid upon said rim structure, and extending therefrom to form a lever, said arm pivot shaft being configured for pivotal engagement with said first end pivot shaft receiving notch, and said ring shaft receiving notch being configured for slideably receiving said second end ring pivot shaft.

16. The container assembly of claim 15 in which said ring pivot shaft is configured having a non-circular cross-section with a principal dimension of extent larger than the said predetermined dimensional extent of said shaft access opening.

17. The container assembly of claim 15 in which said ring pivot shaft receiving notch includes an entrance channel extending toward said pivot end and transitioning to an entrance channel enlargement portion adjacent said shaft bearing surface and dimensioned in correspondence with said ring pivot shaft principal dimension to permit pivotal movement of said ring pivot shaft relative to said shaft bearing surface.

18. The container assembly of claim 17 in which said shaft cross section is oval shaped.

19. The container assembly of claim 15 in which said inwardly opening channel form ring is configured having an outwardly disposed band portion and an integrally formed normally upwardly disposed side and an integrally formed normally downwardly disposed side providing said oppositely disposed side surfaces between said first and second ends; and including a plurality of regularly radially spaced outer rib components extending downwardly from said normally downwardly disposed side.

20. The container assembly of claim 19 in which:

said inwardly opening channel form ring band portion includes a band interior surface and said normally upwardly disposed side includes a side interior surface extending from said band interior surface; and including a plurality of regularly radially spaced inner rib components integrally formed with and extending outwardly from said band interior surface and said side interior surface to provide radially spaced apart abutment edges engageable with said polymeric lid circular peripheral portion.

21. A split ring clamp, comprising:

an inwardly opening, channel-form ring formed of polymeric material having first and second oppositely disposed ends, said first end having oppositely disposed aide surfaces and an outwardly extending rearwardly opening pivot shaft receiving notch, said rim oppositely disposed second end including a receiver channel having oppositely disposed spaced apart sides defining an opening, said spaced apart sides having mutually inwardly facing internal surfaces slideably movable in adjacency over said side surfaces at said first end and including a ring pivot shaft extending between said spaced apart sides forwardly of said opening, a latch component formed integrally with and extending outwardly from said first end, located rearwardly of said pivot shaft receiving notch toward said first end, extending outwardly to a latch tip and having a locking aperture extending therethrough;

a pivot arm having a pivot end with a transversely disposed arm pivot shaft, a ring pivot shaft receiving notch having an outwardly disposed shaft access opening of predetermined dimensional extent extending to a shaft bearing surface a distance selected for drawing together said ring first and second ends, said arm extending from said shaft access opening to form a lever portion having an outwardly disposed surface, said arm pivot shaft being configured for slideable engagement with said ring first end pivot shaft receiving notch, said ring shaft receiving notch being configured for slideably receiving said second end ring pivot shaft, said lever portion being formed having an opening extending through said outwardly disposed surface, a ledge adjacent said opening and a keyway extending across said pivot arm at said opening having a detent formed therein, said latch tip engaging said ledge and said keyway being in alignment with said aperture when said pivot arm is in a closed orientation; and a locking key configured for insertion within said key way through said aperture and across said opening and having a pawl engageable with said detent when inserted within said keyway.

22. The split ring clamp of claim 21 in which said locking key includes a ramp portion slideably movable in engagement with said latch component at said aperture and forming a latching engagement therewith when said pawl is engaged with said detent.

23. The split ring clamp of claim 21 in which:

said pivot arm lever portion is splayed outwardly to form a fingertip receiving region at said keyway; and said locking key is configured having a fingertip conforming surface at the end thereof opposite said pawl, insertable in abutment with said fingertip receiving region when said locking key is fully inserted within said keyway to effect engagement of said pawl with said detent.

24. A spilt ring clamp for retaining a lid upon the rim of a container at the interface therebetween, comprising:

an inwardly opening channel-form ring formed of polymeric material, having first and second oppositely disposed ends, said first end having oppositely disposed side surfaces, having an outwardly extending toe with a first contact surface rearwardly disposed toward second end, and an outwardly extending pivot shaft receiving notch opening rearwardly toward said second end, said ring oppositely disposed second end including a receiver channel having oppositely disposed spaced apart sides defining an opening, said spaced apart sides having mutually inwardly facing internal surfaces slidably movable in adjacency over said side surfaces at said first end, said receiver channel including an inwardly depending toe with a second contact surface configured in correspondence with said first contact surface rearwardly facing toward said first end, said second end receiver channel including a ring pivot shaft having a non-circular, cross section, with a predetermined principal dimension, extending between said spaced apart sides forwardly of said opening; and a pivot arm having a pivot end with a transversely disposed arm pivot shaft, a ring pivot shaft receiving notch having a shaft access opening of predetermined dimensional extent extending to a shaft bearing surface spaced from said arm pivot shaft a distance selected for drawing together said ring first and second ends to an extent effective to cause an abutting, stress transfer engagement of said first contact surface with said second contact surface, and extending therefrom to form a lever having an outwardly disposed surface, said arm pivot shaft being configured for pivotal engagement with said ring first end pivot shaft receiving notch, and said ring pivot shaft receiving notch being configured for slideably receiving said second end ring pivot shaft, said predetermined dimensional extent of said ring pivot shaft being larger than said predetermined dimensional extent of said shaft access opening.

25. The split ring clamp of claim 24 in which said ring pivot shaft cross section is oval shaped.

26. The split ring clamp of claim 24 in which:

said pivot arm is pivotable about said pivot end from an open orientation wherein said lever is generally perpendicular to said ring at said first end wherein said shaft access opening is perpendicular with said ring pivot shaft principal dimension to enable its receipt into said ring shaft receiving notch, toward a closed orientation establishing engagement of said ring pivot shaft with said shaft bearing surface.

27. The split ring clamp of claim 24 in which:

said pivot arm is formed polymeric material; and said arm pivot shaft is formed integrally with said pivot arm.

28. The split ring clamp of claim 24 in which:

said pivot arm lever is formed having a slot extending therethrough including a ledge formed therein at a location inwardly disposed from said outer surface; and including a latch component formed integrally with and extending outwardly from said channel form ring first end to a latch tip an extent sufficient to engage with said ledge without extending outwardly from said pivot arm outwardly disposed surface.

29. The split ring clamp of claim 24 in which said inwardly opening channel form ring is configured having an outwardly disposed band portion and an integrally formed normally upwardly disposed side and an integrally formed normally downwardly disposed side providing said oppositely disposed side surfaces between said first and second ends; and including a plurality of regularly radially spaced outer rib components extending downwardly from said normally downwardly disposed side.

30. The split ring clamp of claim 24 in which:

said inwardly opening channel form ring band portion includes a band interior surface and said normally upwardly disposed side includes a side interior surface extending from said band interior surface; and including a plurality of regularly radially spaced inner rib components integrally formed with and extending outwardly from said band interior surface and said side interior surface to provide radially spaced apart abutment edges.

31. The split ring clamp of claim 24 in which said outwardly extending toe, said pivot shaft receiving notch, said receiver channel, said inwardly depending toe and said ring pivot shaft are formed, integrally with said ring.

32. The split ring clamp of claim 31 in which said inwardly depending toe of said receiver channel is disposed rearwardly toward said first end from said opening.

* * * * *